US005933179A

United States Patent [19]

Fogle et al.

[11] Patent Number: 5,933,179

[45] Date of Patent: Aug. 3, 1999

[54] METHOD OF INSURING PRINT QUALITY OF A THERMAL PRINTER

[75] Inventors: Ronald L. Fogle, Springboro; Stephen F. Goldberg, Dayton, both of Ohio

[73] Assignee: Pitney Bowes Inc., Stamford, Conn.

[21] Appl. No.: 08/240,199

[22] Filed: May 9, 1994

Related U.S. Application Data

[63] Continuation-in-part of application No. 07/994,000, Dec. 21, 1992, abandoned.

[51] Int. Cl.[6] ..... B41J 2/36

[52] U.S. Cl. ..... 347/188

[58] Field of Search ..... 347/188; 400/120.09

[56] References Cited

U.S. PATENT DOCUMENTS 4,827,279 5/1989 Lubinsky et al. ..... 346/1.1

4,843,409 6/1989 Matsuzaki ..... 346/76 PH 4,939,581 7/1990 Shalit ..... 358/244

*Primary Examiner*—Huan Tran

*Attorney, Agent, or Firm*—Angelo N. Chaclas; Charles G. Parks, Jr.; Melvin J. Scolnick

[57] ABSTRACT

A method of selectively setting the print cycle speed of a thermal printing apparatus such as a thermal postage meter. The thermal postage meter has a thermal print head and an optical reader under the control of a micro controller for printing an image on a sheet like material comprising the steps of first causing said micro processor to be programmed to first cause said thermal print head to print a test pattern just prior to print said image. The optical reader reads said the pattern intensity. The microprocessor is programmed to select a print cycle speed as a function of the test pattern intensity.

3 Claims, 3 Drawing Sheets

METHOD OF INSURING PRINT QUALITY OF A THERMAL PRINTER

This application is a continuation-in-part of application Ser. No. 07/994,000, filed on Dec. 21, 1992 now abandoned.

BACKGROUND OF THE INVENTION

The present invention relates to a thermal printing apparatus and, more particularly, to a postage meter thermal printing apparatus.

Conventional thermal printing apparatus, such as, thermal printing labelers or typewriters, are intended to print on a rather uniform grade of paper stock. As a result, the print cycle speed may be optimized for the paper stock that will be printed on.

By contrast, postage meters are preferred to print a high quality postage indicia on a variety of paper stock, hence, the difficulty in applying thermal printing techniques to postage meter and alike printing.

SUMMARY OF THE PRESENT INVENTION

It is an object of the present invention to present a method of adjusting the print cycle speed in response to the print contrast during a thermal print cycle.

A thermal printing postage meter includes a base that supports a mail piece transport deck. The base also supports a vertically extending registration wall along the back side of the deck. Detachably mounted to the registration is a transfer ribbon cassette mounted such that a portion of the transfer ribbon travels below a thermal print head of the postage meter. The thermal print head is mounted to the registration wall and provides a backing for the thermal ribbon. Just, downstream of the thermal print head is an optical lamp and detector pair. The optical pair is located relative to the thermal print head, such that, upon initiation of a print cycle, the thermal print head is caused to print a test pattern by the system microcomputer just prior to printing the indicia. The test pattern is presented over a small lead area. The detection pattern is detected by the optical detector. The amount of ink transferred and detected to the receiving media varies according to several physical properties such as surface smoothness, adhesion characteristics, ambient and temperature, and also on the physical characteristics of the test pattern. On the basis of upon the average pattern density of the detected pattern the micro controller adjusts the cycle speed or other transfer parameters if the average pattern density is below a threshold value.

DETAILED DESCRIPTION OF THE PREFERRED EMBODIMENT

Figure 1:
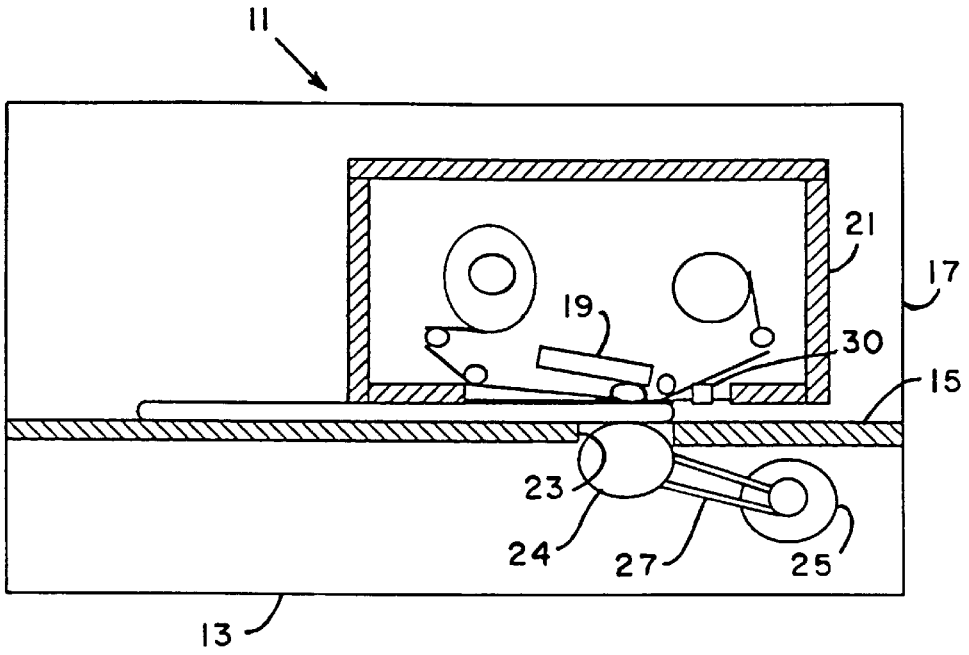
FIG. 1 is a front elevated view of a thermal printing postage meter in accordance with the present invention.

Referring to FIG. 1, thermal printing postage meter, generally indicated a 11, is composed of a base 13 that supports a deck 15 and vertically extending registration wall

17 along the back side of the deck 15. Fixably mounted to the registration wall to extend over a portion of the deck 15 is a thermal print head 19. The thermal print head 19 is a "dumb" print head, where voltage across individual print head elements cannot be varied. Voltage can only be varied in gross. A thermal ribbon cassette 21 is detachably mounted to the registration wall such that a portion of the thermal transfer ribbon extends below and is backed by the thermal print head 19. The thermal ribbon cassette 21 is under the influence of a drive system (not shown). A platen roller assembly that includes a platen roller 24 is rotatively mounted in the base by suitable means such that a portion of the roller 24 extends through a slot 23 in the deck 15 opposite the thermal print head 19. The platen roller 24 is rotatively driven by a motor 25 through an endless belt 27. A detailed description of a particularly suitable thermal printing postage meter is described in U.S. patent application Ser. No. 07/950,341, now issued as U.S. Pat. No. 5,325,114 commonly assigned and incorporated herein by reference.

Figure 2A:
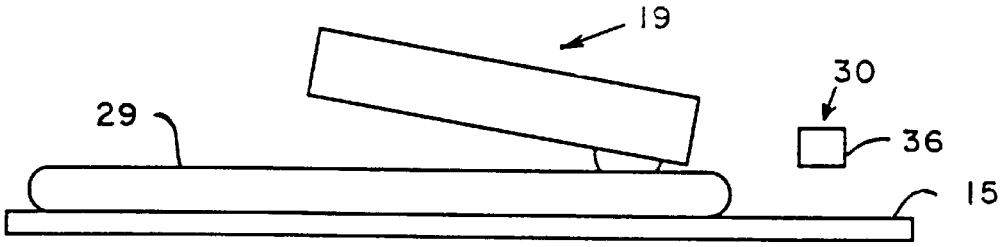
FIGS. 2A and 2B are schematics of the thermal print head location relative to the optical pair in accordance with the present invention.
Figure 2B:
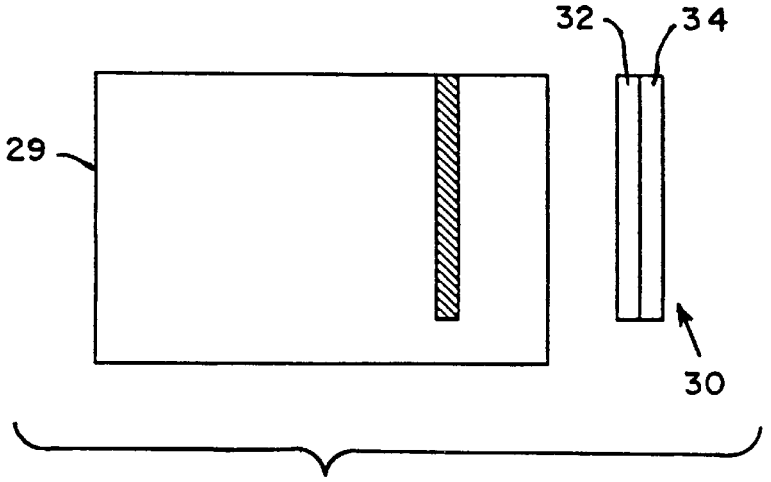

Referring to FIGS. 1, 2A and 2B, an optical pair, generally indicated as 30, includes an elongated lamp 32 and parallel extending detector 34 within a housing 36. The housing 36, inclusive of the lamp 32 and detector 34, are mounted to the registration wall 17 just down stream of the thermal print head 19 to extend over the deck. The alignment of the optical pair 30 is such that the thermal printed area of an envelope 29 on the deck 15 will pass below the optical pair 30.

Figure 3:
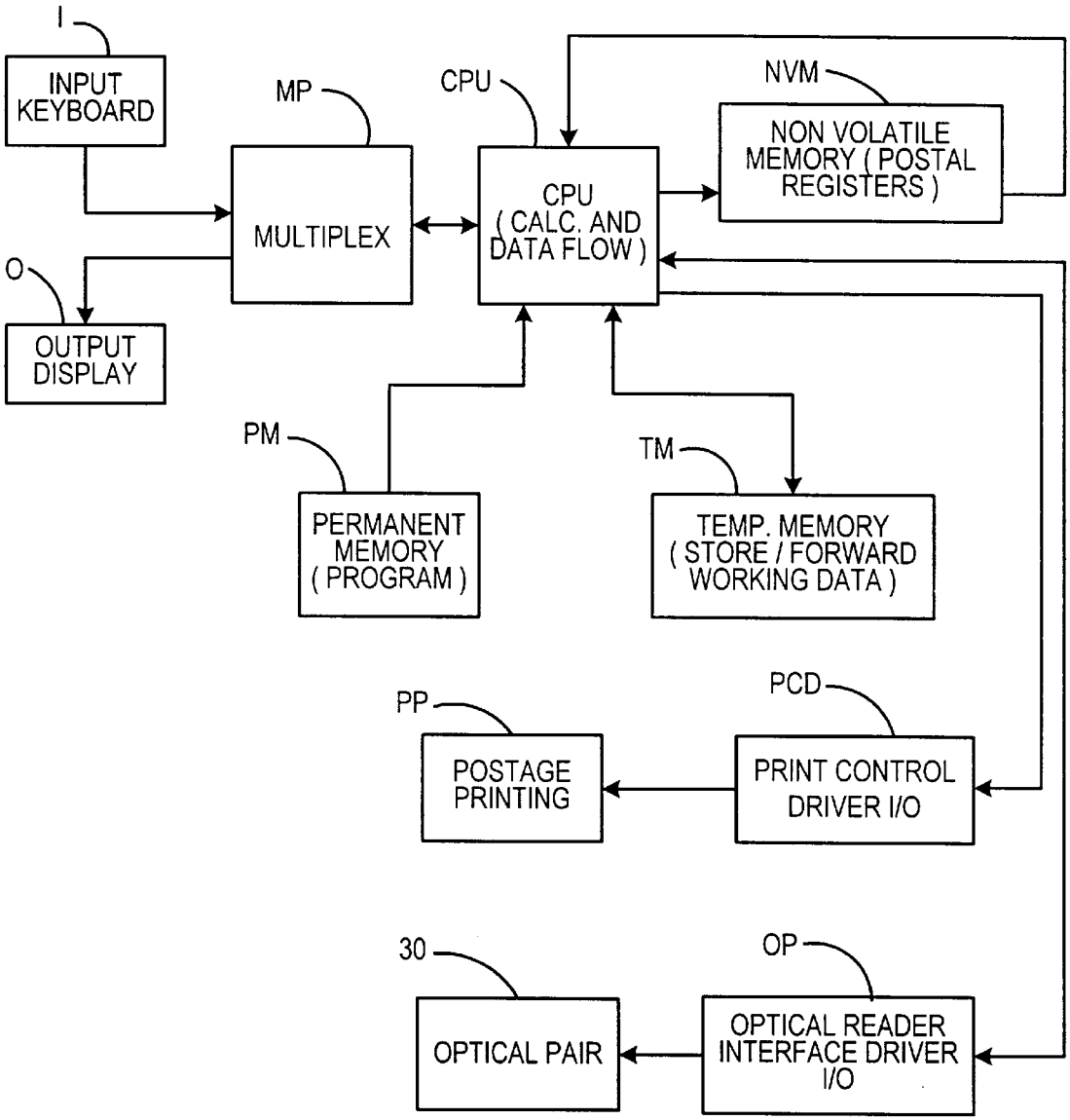
FIG. 3 is schematic of a suitable micro-controller in accordance with the present invention.
Figure 4:
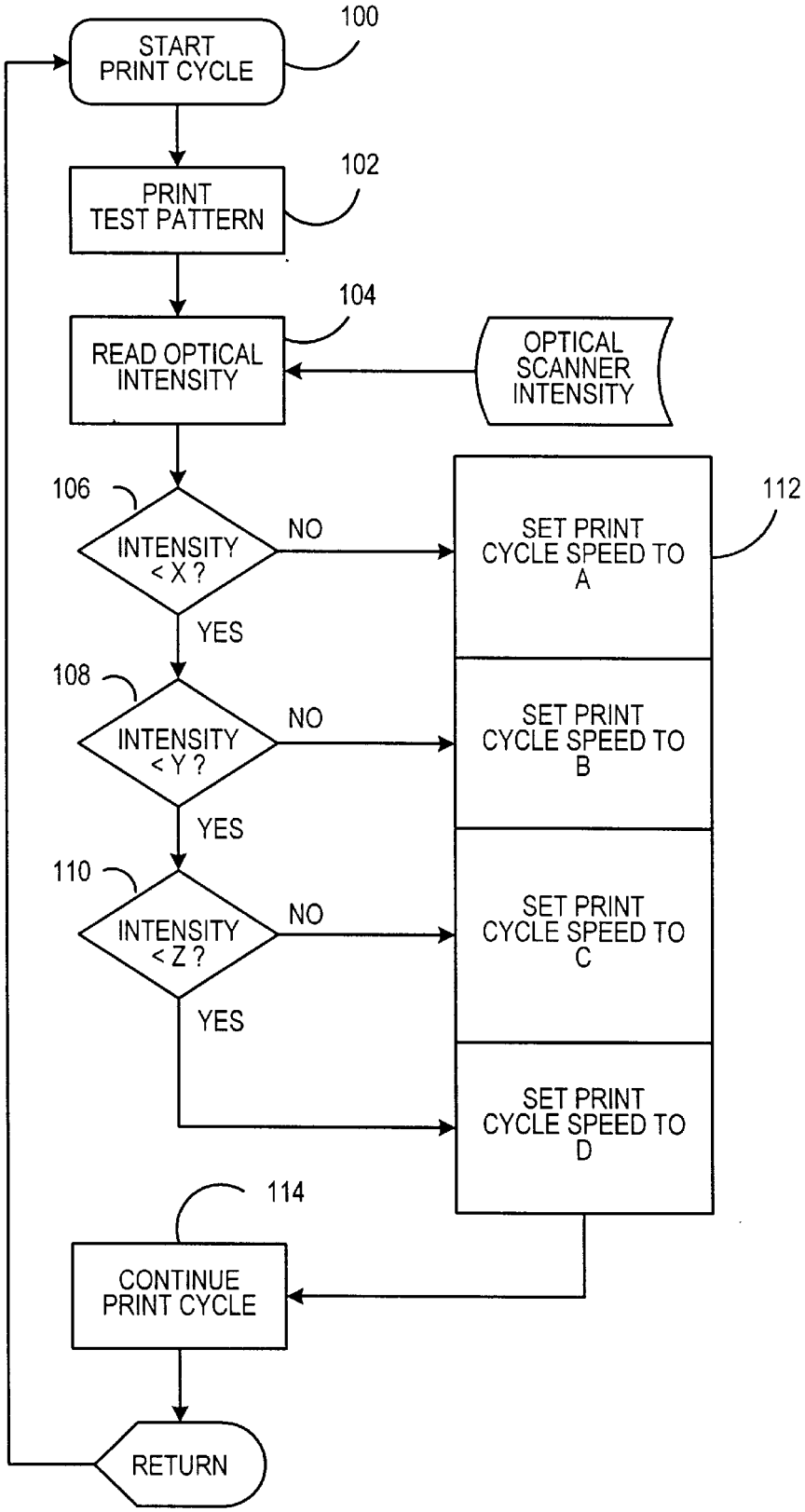
FIG. 4 is schematic of a logic flow in accordance with the present invention.

Referring to FIGS. 3 and 4, the postage meter 11 is under the controlling influence of a programmable micro controller 40. The micro controller includes a CPU that is utilized with specific instructions programmed in the read only memory (PM), for the performance of control of the basic meter functions, for the performance of calculations based on any input data and for controlling the flow of data into the various memories.

The system may operate in accordance with data applied from an appropriate input means "I" or from a communications means such as described for instance in U.S. Pat. No. 4,301,507 to Soderberg also specifically incorporated herein by reference. The data is fed into the microprocessor under control of the program in Read Only Memory and at any time during the operation of the system, should the contents of the memory storing the appropriate credit/debit balance or other cumulating in accordance with various features of the system by the input means "I" cause the CPU to access the desired locations in memory that store the information requested. The information may be displayed on an output unit "O". As well known, the input and output units may be multiplexed by a suitable multiplex unit "MP" for transferring data to and from the CPU. Also, in communication with the CPU is the print control driver "PCD" and the optical reader interface driver (OP). It should be apparent that any conventional and suitable print control driver "PCD" that herein refers to both the motor drivers and thermal print head driver. It should be apparent that any suitable optical reader OR may be employed.

Stored in the permanent memory "PM" is a suitable print cycle program. As a part of said print cycle program is a new routine. Upon entering the print routine at 100, the routine is entered. At logic block 102, the CPU actuates the PCD resulting in the thermal head producing a test pattern and concurrently actuates the optical reader OR. As the print cycle continues, the test pattern encounters the optical pair 30 that read the intensity of the test pattern at logic block 104. As used here, test pattern image intensity is intended to include pattern density or other suitably measurable physical parameter of the test pattern which can be related to image quality. The test pattern image intensity is an average measure taken over the entire print area. At logic 106, the test pattern intensity is compared to level "X". If the test pattern is less than level "X", the routine proceeds to logic block 108 where the intensity is compared to level "Y". If the test pattern intensity is less than level "Y", the routine proceeds to logic block 110, where the intensity is compared to level "Z". If at any logic block 106, 108 and 110, the intensity is greater than the respective level, the routine proceeds to logic block 112 wherein the print cycle speed is accordingly selected from a look-up table and the routine proceeds to execute the print cycle at logic 114. It should be noted that the other printing control parameter, such as, print head transfer temperature, may alternatively be adjusted to improve print quality singularly or in combination with varying print speeds.

It should be appreciated that the afore described represents the preferred embodiment of the invention and should not be view as limiting. The scope of the claims is defined by the appended claims.

What is claimed is:

1. A method of printing a postal indicia using a thermal transfer printer including a thermal print head having an array of print elements, an optical reader and a micro control system in operative communication with both the thermal print head and the optical reader, the method comprising the step(s) of:

prior to printing the postal indicia, printing a test pattern over a print area using the array of print elements, the test pattern having an associated average intensity over the print area;

reading the associated average intensity of the test pattern using the optical reader;

obtaining an output from the optical reader representative of the associated average intensity;

establishing a print control parameter of the control system applied uniformly over the array of print elements at a desired level as a function of the output; and using the print control parameter at the desired level to control the thermal print head to print the postal indicia.

2. The method of claim 1 wherein the print control parameter is a print cycle speed and the test pattern is printed at a given speed and further comprising the step(s) of:

comparing the output to a first previously established comparison level;

if the output is greater than the first previously established comparison level, setting the desired level of the print cycle speed to a first previously established speed;

if the output is less than the first previously established comparison level, comparing the output to a second previously established comparison level less than the first previously established comparison level;

if the output is greater than the second previously established comparison level, setting the desired level of the print cycle speed to a second previously established speed less than the first previously established speed; and if the output is less than the second previously established comparison level, setting the desired level of the print cycle speed to a third previously established speed less than the second previously established speed.

3. The method of claim 2 further comprising the step(s) of:

setting the first previously established speed equal to or greater than the given speed; and setting the third previously established speed equal to or less than the given speed.

* * * * *